US005131822A

United States Patent [19]

Yamamoto et al.

[11] Patent Number: 5,131,822

[45] Date of Patent: Jul. 21, 1992

[54] MOTOR-DRIVEN FUEL PUMP

[75] Inventors: Shoichi Yamamoto; Shigeru Yoshida; Yoshimasa Ito, all of Obu, Japan

[73] Assignee: Aisan Kogyo Kabushiki Kaisha, Obu, Japan

[21] Appl. No.: 627,046

[22] Filed: Dec. 13, 1990

[30] Foreign Application Priority Data

Dec. 16, 1989 [JP] Japan ..... 1-145172[U]

[51] Int. Cl.[5] ..... F04B 39/02; F04B 17/00; F04B 35/04; H01R 39/40

[52] U.S. Cl. ..... 417/423.7; 417/423.14; 417/366; 310/245

[58] Field of Search ..... 417/423.7, 423.14, 366; 310/245

[56] References Cited

U.S. PATENT DOCUMENTS 4,112,321 9/1978 Wan ..... 310/245
4,778,354 10/1988 Idei ..... 417/423.14
4,784,587 11/1988 Takei et al. ..... 417/423.14

FOREIGN PATENT DOCUMENTS 106396 11/1988 Japan ..... 417/423.7

*Primary Examiner*—Richard A. Bertsch
*Assistant Examiner*—Alfred Basichas
*Attorney, Agent, or Firm*—Dennison, Meserole, Pollack & Scheiner

[57] ABSTRACT

A motor-driven fuel pump including a cylindrical housing; a pump section fixedly mounted at one end portion of the housing so as to close the one end portion; a motor section mounted in the housing for driving the pump section; and a cover member fixedly mounted at the other end portion of the housing so as to close the other end portion by caulking an end of the housing; wherein an outer end surface of the cover member projects outwardly from the caulked end of the housing to increase a wall thickness of the cover member without increasing a total length of the housing, whereby a sound from the motor section is reduced.

5 Claims, 6 Drawing Sheets

MOTOR-DRIVEN FUEL PUMP

BACKGROUND OF THE INVENTION

The present invention relates to a motor-driven fuel pump of an in-tank type to be mounted in a fuel tank of an automobile or the like.

A known motor-driven fuel pump of this type includes a cylindrical housing, a pump section fixedly mounted at one end portion of the housing so as to close the one end portion, a motor section mounted in the housing for driving the pump section, and a cover member fixedly mounted at the other end portion of the housing so as to close the other end portion by caulking an end of the housing.

Generally, the end of the housing is caulked to surround a circumferential edge of an outer end surface of the cover member.

In the above known motor-driven fuel pump, it is intended to reduce an operating sound of the pump by increasing a wall thickness of the cover member. However, such an increase in wall thickness of the cover member accompanies an increase in total length of the housing, causing vibration of the housing to generate transmission, conduction and resonance of a motor sound. In contrast, if the wall thickness of the motor cover is reduced, the transmission of the motor sound from the motor section through the motor cover tends to be generated. Thus, a reduction in the operating sound of the pump in the prior art is not fully satisfied. Particularly in the in-tank type motor-driven fuel pump located behind a rear seat of the automobile, the operating sound of the pump is undesirably transmitted to a passenger on the rear seat. Accordingly, it has been demanded to fully reduce the operating sound of the pump.

SUMMARY OF THE INVENTION

It is accordingly an object of the present invention to provide a motor-driven fuel pump which can prevent the transmission or the like of a motor sound to thereby reduce an operating sound of the pump.

According to the present invention, there is provided a motor-driven fuel pump comprising a cylindrical housing; a pump section fixedly mounted at one end portion of said housing so as to close the one end portion; a motor section mounted in said housing for driving said pump section; and a cover member fixedly mounted at the other end portion of said housing so as to close the other end portion by caulking an end of said housing; wherein an outer end surface of said cover member projects outwardly from the caulked end of said housing to increase a wall thickness of said cover member without increasing a total length of said housing, whereby a sound from said motor section is reduced.

With this construction, as the wall thickness of the cover member is increased, the transmission of the motor sound through the cover member can be prevented. Further, as the outer end surface of the cover member projects outwardly from the caulked end of the housing, an increase in total length of the housing due to an increase in wall thickness of the cover member can be avoided to thereby suppress the vibration of the housing and accordingly prevent an increase in transmission, conduction and resonance of the motor sound due to the vibration of the housing.

The invention will be more fully understood from the following detailed description and appended claims when taken with the drawings.

DETAILED DESCRIPTION OF THE PREFERRED EMBODIMENTS

There will now be described a preferred embodiment of the present invention with reference to the drawings. The motor-driven fuel pump in this preferred embodiment is of a so-called in-tank type such that the pump is used under a submerged condition in a fuel tank of an automobile or the like.

Figure 1:
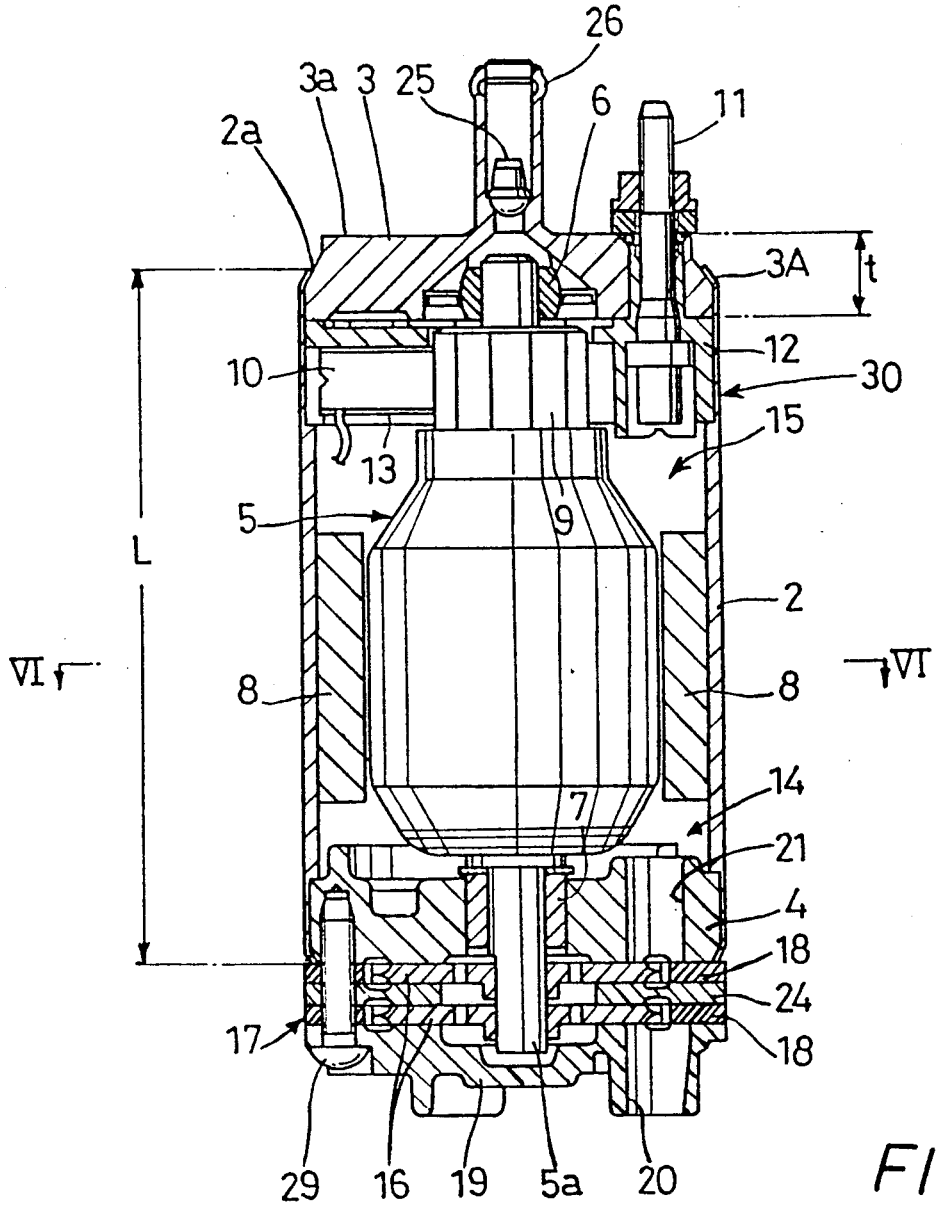
FIG. 1 is a vertical sectional view of the motor-driven fuel pump according to a preferred embodiment of the present invention.
Figure 2:
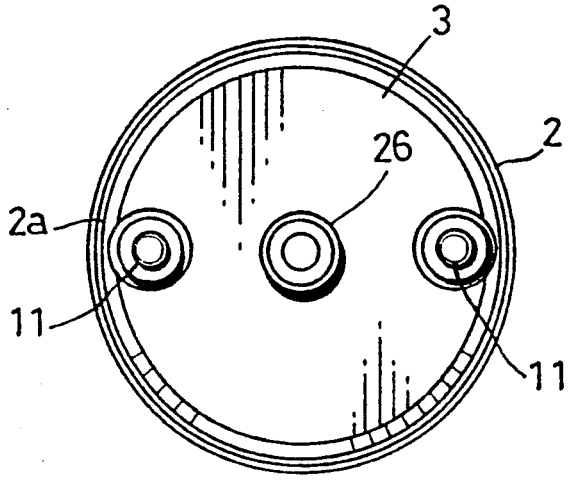
FIG. 2 is a top plan view of FIG. 1.

Referring to FIGS. 1 and 2, the motor-driven fuel pump is generally constructed of a cylindrical housing 2 formed of a thin metal plate, a pump section 14 fixedly mounted at a lower end portion of the housing 2, a motor section (cover member) 15 mounted above the pump section 14 in the housing 2, and a motor cover 3 fixedly mounted at an upper end portion of the housing 2. A pump cover 4 of the pump section 14 is press-fitted with the lower end portion of the housing 2, and is fixed by caulking a lower end of the housing 2. Similarly, the motor cover 3 mounted above the motor section 15 is press-fitted with the upper end portion of the housing 2, and is fixed by caulking an upper end of the housing 2. An armature 5 of the motor section 15 has a rotating shaft **5*a* rotatably supported through an upper bearing 6 and a lower bearing 7 to the motor cover 3 and the pump cover 4, respectively. A pair of magnets 8 are fixed to an inner circumferential surface of the housing 2 in opposed relationship to each other so as to define a clearance as a fuel passage between the same and the armature 5 (see FIG. 6**).

Figure 3:
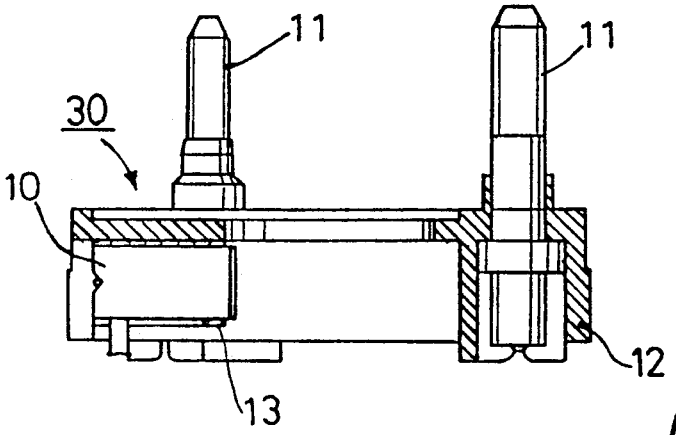
FIG. 3 is a vertical sectional view of a conductor section shown in FIG. 1.
Figure 4:
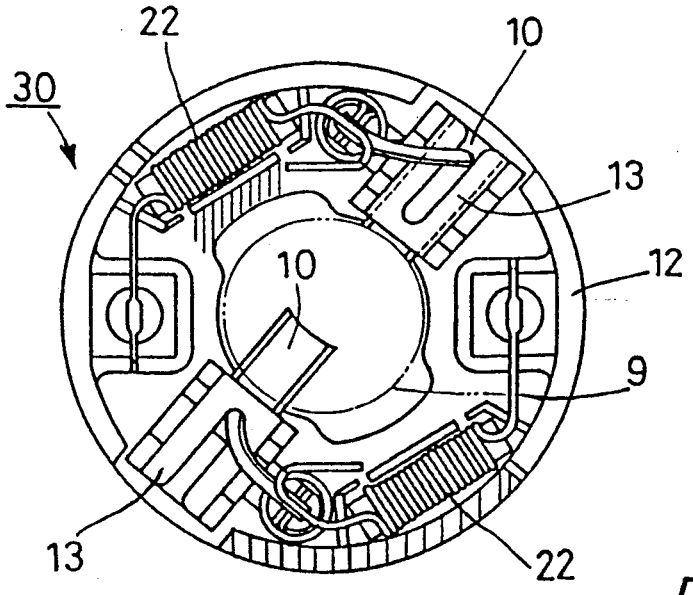
FIG. 4 is a bottom plan view of FIG. 3.
Figure 5A:
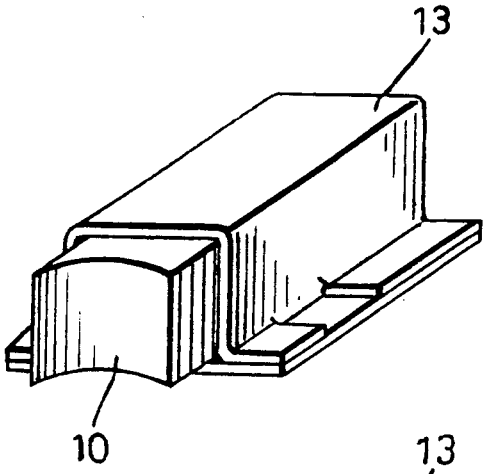
FIG. 5A is a perspective view of a brush holder and a brush shown in FIG. 3.
Figure 5B:
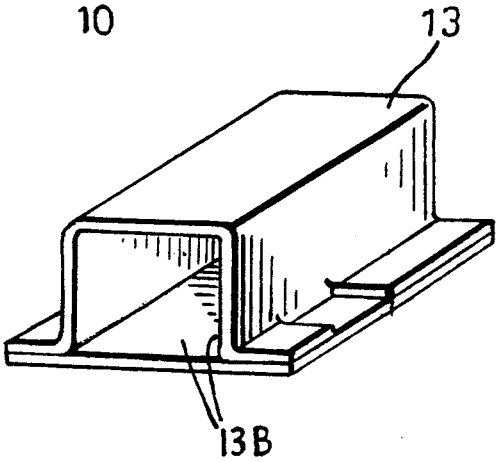
FIG. 5B is a perspective view of a brush holder in FIG. 5A with the brush removed.

A conductor section 30 constituting a part of the motor section 15 is interposed between the armature 5 and the motor cover 3. As shown in FIGS. 3 and 4, the conductor section 30 includes a body 12 formed of synthetic resin, a pair of connection terminals 11 fixedly supported to the body 12 and adapted to be connected to an external power supply, a pair of brushes 10 adapted to contact a commutator 9 mounted on an upper end of the armature 5 and thereby supply current thereto, a pair of brush holders 13 fixed to the body 12 for movably supporting the respective brushes 10 therein, and a pair of choke coils 22 for connecting the brushes 10 to the connection terminals 11, respectively. As shown in FIG. 4, the brushes 10 supported in the brush holders 13 are disposed in opposed relationship to each other so as to contact an outer circumferential surface of the commutator 9. However, in FIG. 4, it is shown that one of the brushes 10 is in a projected condition where it is urged by a spring (not shown) accommodated in the brush holder 13 to project outwardly at the maximum before contacting the commutator 9. As shown in FIG. 5A, the brush 10 has a shape substantially fitting with the brush holder 13 such that opposite side surfaces of the brush 10 are in entirely sliding contact with an inner surface of the brush holder 13. Further, as shown in FIG. 5B, the inner surface of the brush holder 13 is coated with fluororesin 13B for the purpose of smooth sliding of the brush 10.

Referring back to FIG. 1, the pump section 14 to be driven by the motor section 15 is constructed by a two-stage regenerative pump including two impellers 16 connected to a lower end portion of the rotating shaft 5*a* of the armature 5 and a pump casing 17 surrounding the impellers 16. The pump casing 17 is composed of the pump cover 4, a pump body 19, a pair of upper and lower spacers 18, and an intermediate plate 24 interposed between the upper and lower spacers 18. The pump body 19, the upper and lower spacers 18 and the intermediate plate 24 are fixed by screws 29 to the pump cover 4. The pump body 19 is formed with a fuel inlet hole 20, and the pump cover 4 is formed with a fuel outlet hole 21. Although both the fuel inlet hole 20 and the fuel outlet hole 21 are shown in alignment in FIG. 1, they are actually located at a circumferential given interval.

The motor cover 3 is formed with a discharge portion 26 for discharging the fuel pumped up into the housing 2 by the pump section 14 to the outside of the housing 2, e.g., a fuel supply pipe leading to a fuel injector. Further, a check valve 25 permitting flow from the housing 2 only is provided in the discharge portion 26.

In operation, when the motor section 15 is driven by an external power supply such as an automotive battery, the impellers 16 in the pump section 14 are rotated. Accordingly, the fuel in a fuel tank is sucked from the fuel inlet hole 20 into the pump casing 17. Then, the fuel is fed under pressure through a flow passage in the pump casing 17 to the fuel outlet hole 21. The fuel pumped up from the fuel outlet hole 21 enters the housing 2, thereafter being discharged from the discharge portion 26 of the motor cover 3.

Now, the essential features of the motor-driven fuel pump according to the present invention will be described.

First, as shown in FIG. 1, the motor cover 3 has a wall thickness t increased by upwardly projecting an upper end surface 3*a* of the motor cover 3 from a caulked upper end 2*a* of the housing 2. The motor cover 3 is formed at its outer circumference with a shoulder portion 3A on which the upper end 2*a* of the housing 2 is caulked. With this construction, as the wall thickness t of the motor cover 3 is increased, the transmission of a motor sound from the motor section 15 through the motor cover 3 can be prevented. Furthermore, as the upper end surface 3*a* of the motor cover 3 upwardly projects from the caulked upper end 2*a* of the housing 2, an increase in total length L of the housing 2 due to an increase in wall thickness of the motor cover 3 can be avoided to thereby prevent the vibration of the housing 2 and accordingly prevent the transmission, conduction and resonance of the motor sound due to the vibration of the housing 2. As a result, an operating sound of the motor-driven fuel pump to be caused by the motor sound can be reduced.

Secondly, the motor cover 3 is formed of a material capable of reducing sound conduction, such as a material having a large specific gravity or a vibration isolating alloy. As the material having a large specific gravity, the preferred embodiment employs iron having a specific gravity larger than that of aluminum employed in the prior art. Accordingly, the isolation of the motor sound can be improved by the use of the above-mentioned material for the motor cover 3.

Figure 6:
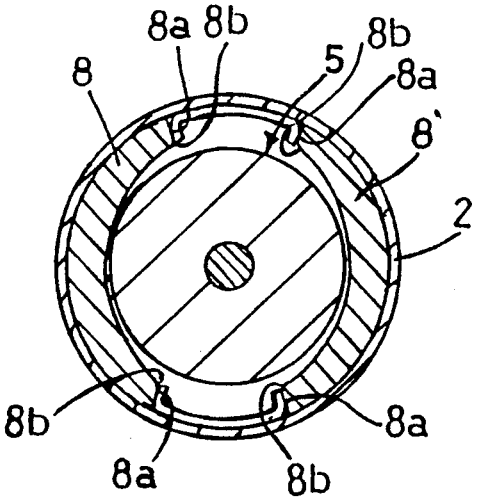
FIG. 6 is a cross section taken along the line VI—VI in FIG. 1.

Thirdly, as shown in FIG. 6, each of the magnets 8 has a wall thickness gradually decreasing from a circumferentially central portion to opposite ends 8*a*, and each of the opposite ends 8*a* is chamfered at its inner edge to form a round surface 8*b*. With this construction, a cogging torque of the armature 5 can be reduced to thereby effectively reduce a peak sound at a frequency corresponding to a multiple of the number of core grooves of the armature 5.

Figure 8:
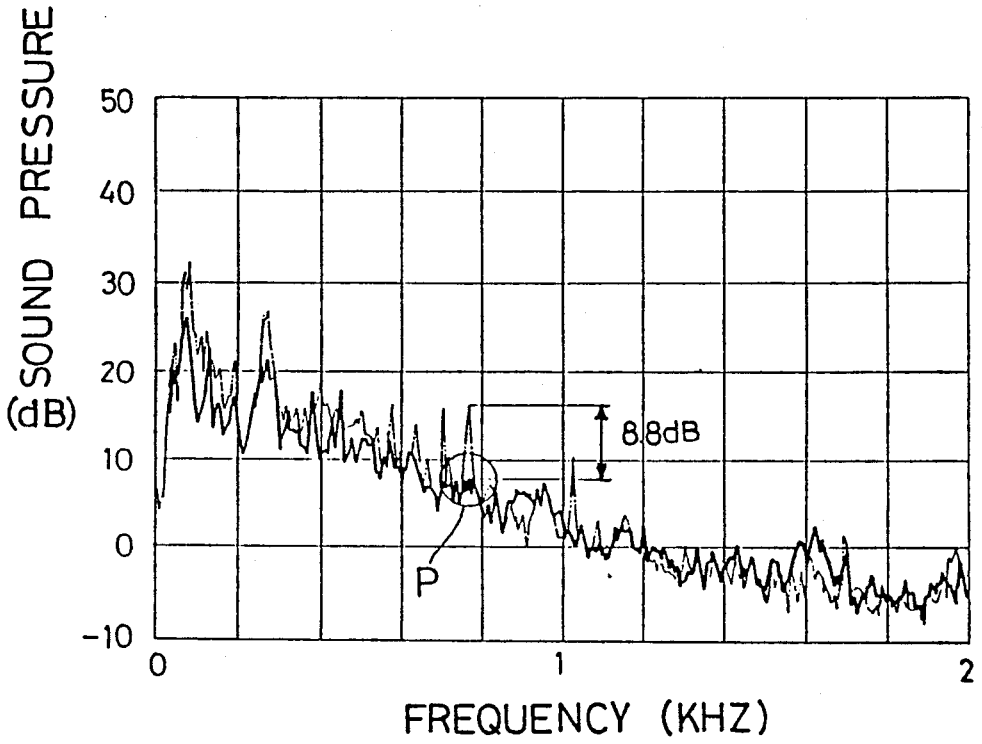
FIG. 8 is a graph illustrating a sound pressure-frequency characteristic of an operating sound of the pump.

FIG. 8 shows a sound pressure-frequency characteristic according to the present invention (solid line) in comparison with the prior art (chain line) obtained by mounting the motor-driven fuel pump on an automobile and collecting an operating sound of the pump with a microphone placed at a position near the ears of a passenger on a rear seat of the automobile. As apparent from FIG. 8, a peak sound audibile by the passenger is generated at the frequency of 0.7 to 0.8 kHz (as shown by a circle P). According to the present invention, the sound pressure of the peak sound is reduced by 8.8 dB than that in the prior art.

The present inventors have evaluated the effect of reduction in the sound pressure to be obtained by each featured construction as mentioned above in comparison with the prior art. The following is the results of evaluation as measured at the frequency of 0.7 to 0.8 kHz.

Figure 9:
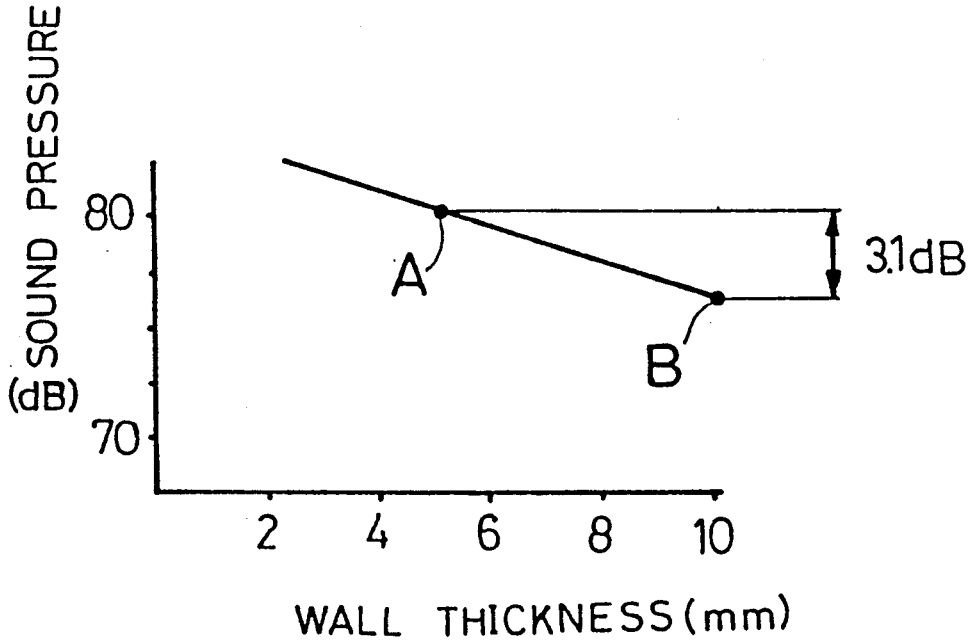
FIG. 9 is a graph illustrating the effect by the increased wall thickness of the motor cover.

(1) Effect by an increased wall thickness of the motor cover 3:

Referring to FIG. 9, a sound pressure in case of the wall thickness t = 10 mm at a point B is smaller than that in case of the wall thickness t = 5 mm at a point A, and a difference in sound pressure is 3.1 dB. Thus, it is understood that an increase in wall thickness of the motor cover 3 improves the sound insulation property. In this evaluation, it is common that the material of the motor cover 3 is iron, and the wall thickness of the magnets 8 is uniform.

Figure 10:
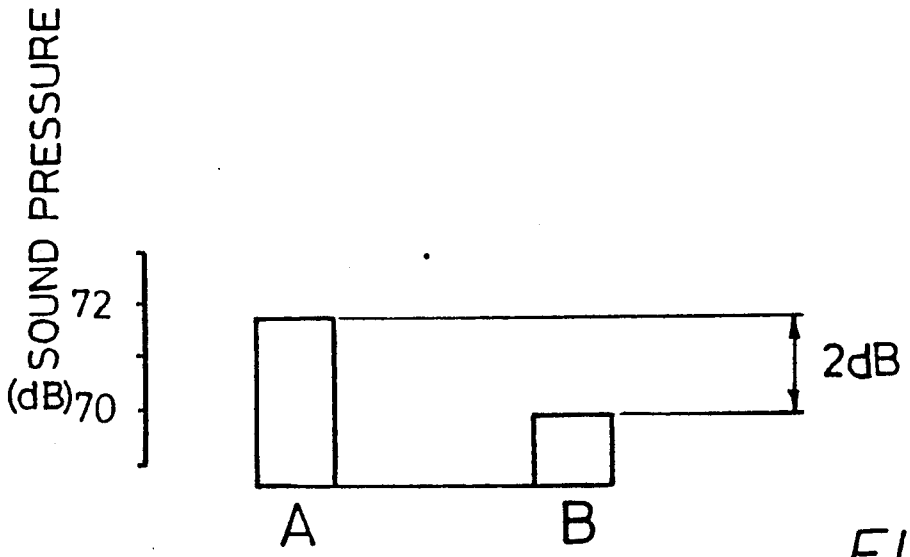
FIG. 10 is a graph illustrating the effect by the reduced total length of the housing.

(2) Effect by a reduced total length L of the housing 2:

Referring to FIG. 10, a sound pressure in case of the relatively short total length (a length of a connected portion of the housing 2 including the caulked end portion to the motor cover 3 is 5.5 mm) as represented by a bar B is smaller than that in case of the relatively long total length (the length of the above-mentioned connected portion is 10.0 mm) as represented by a bar A, and a difference in sound pressure is 2.0 dB. Thus, it is understood that a reduction in total length of the housing 2 improves the sound insulation property. In this evaluation, it is common that the material of the motor cover 3 is iron, and the wall thickness of the magnets 8 is ununiform as shown in FIG. 6.

Figure 11:
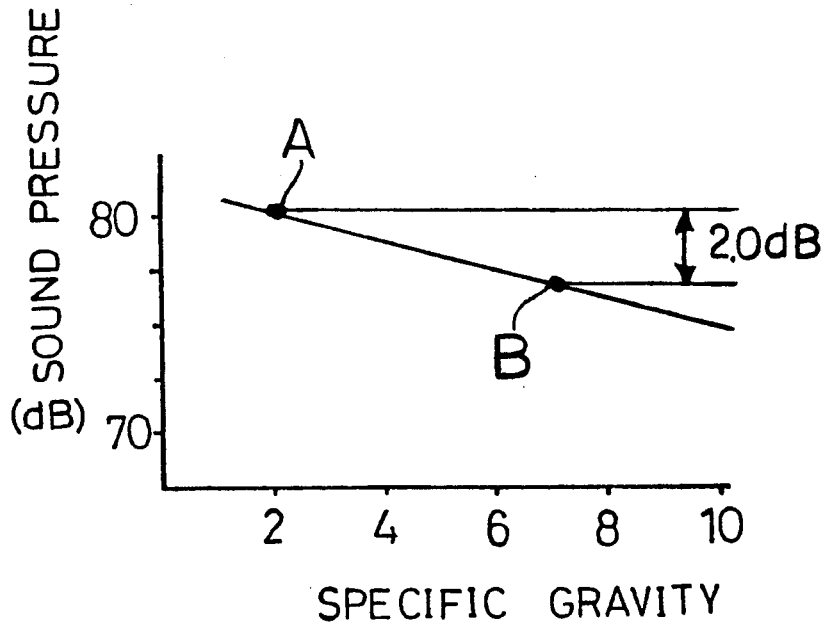
FIG. 11 is a graph illustrating the effect by the material of the motor cover.

(3) Effect by the material of the motor cover 3:

Referring to FIG. 11, a sound pressure in case of iron (specific gravity: 6.9) at a point B is smaller than that in case of aluminum (specific gravity: 2.7) at a point A, and a difference in sound pressure is 2.0 dB. Thus, it is understood that the material having a large specific gravity improves the sound insulation property. In this evaluation, it is common that the wall thickness t of the motor cover 3 is 10 mm, and the wall thickness of the magnets 8 is uniform.

Figure 12:
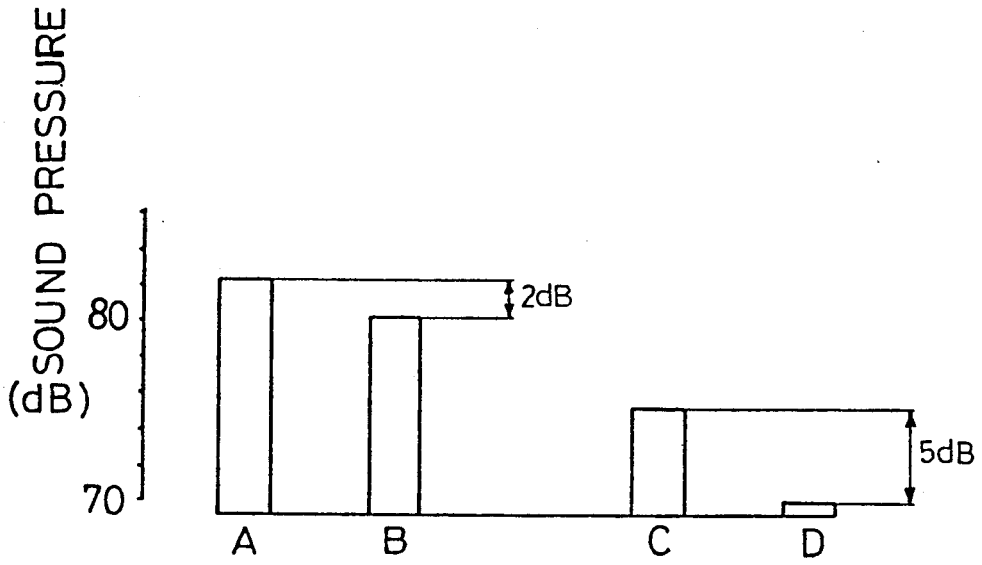
FIG. 12 is a graph illustrating the effect by the ununiformity of the wall thickness of a magnet in the motor section.

(4) Effect by the ununiform wall thickness of the magnets 8:

Referring to FIG. 12, a sound pressure in case of the ununiform wall thickness as represented by a bar B is smaller than that in case of the uniform wall thickness as represented by a bar A, and a difference in sound pressure is 2.0 dB. In this evaluation, it is common that the material of the motor cover is aluminum, and the wall thickness t of the motor cover is 5 mm. Further, a sound pressure in case of the ununiform wall thickness as represented by a bar D is smaller than that in case of the uniform wall thickness as represented by a bar C, and a difference in sound pressure is 5.0 dB. In this evaluation, it is common that the material of the motor cover is iron, and the wall thickness t of the motor cover is 10 mm. Thus, it is understood that the ununiformity of the wall thickness of the magnets 8 as shown in FIG. 6 improves the sound insulation property.

Figure 13:
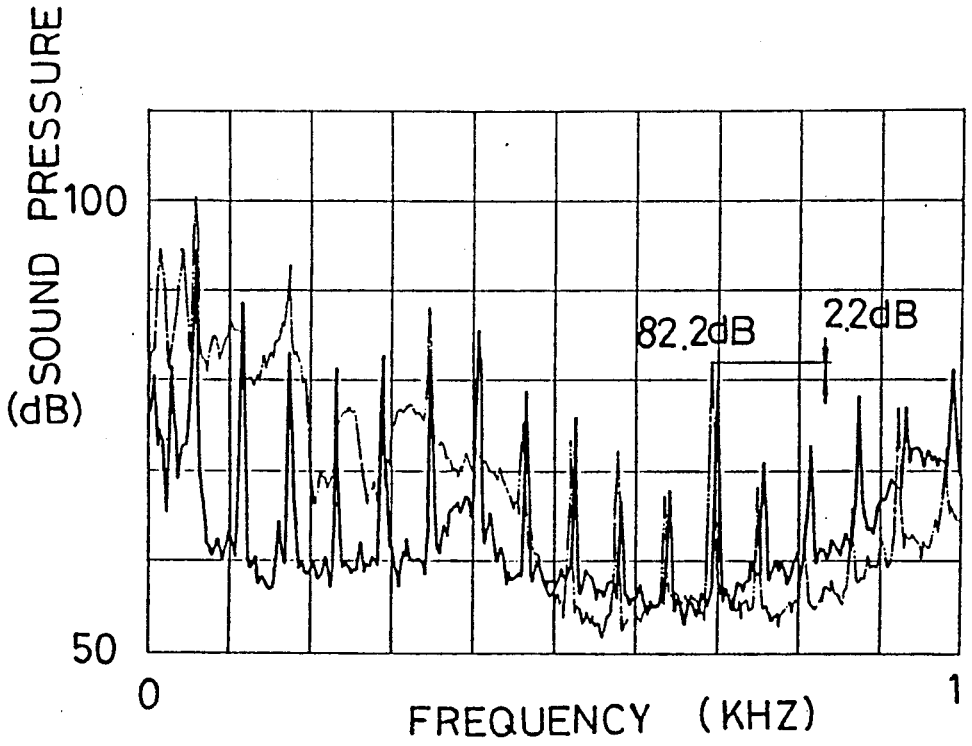
FIG. 13 is a graph illustrating the effect by the fluororesin coating on an inner surface of the brush holder.

(5) Effect by the fluororesin coating on the inner surface of the brush holder 13:

Referring to FIG. 13, a solid line of the graph shows the case where the fluororesin coating is applied to the inner surface of the brush holder 13, while a chain line of the graph shows the case where the fluororesin coating is not applied to the inner surface of the brush holder 13. As apparent from FIG. 13, a sound pressure at the frequency of 0.7 kHz in the case where the fluororesin coating is applied is reduced by 2.2 dB than that (82.2 dB) in the case where the fluororesin coating is not applied.

Figure 7:
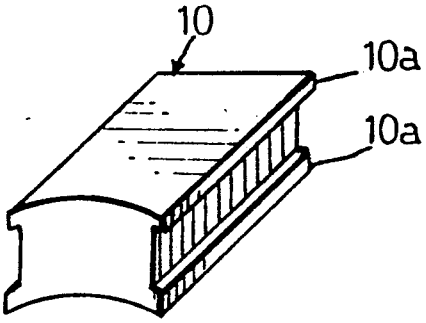
FIG. 7 is a perspective view of a modification of the brush.

Referring to FIG. 7 which shows a modification of the brush 10, the brush 10 is formed at each side surface thereof with a pair of guide projections 10*a*, so as to reduce a contact area of the brush 10 with the inner surface of the brush holder 13. With this construction, the transmission of vibration can be reduced to contribute to a reduction in the operating sound.

Further, although the increase wall thickness t of the motor cover 3 is obtained without increasing the total length L of the housing 2 in the above preferred embodiment, the total length L of the housing 2 may be reduced in addition to the increase in the all thickness t of the motor cover 3, thereby further reducing the operating sound.

Having thus described the preferred embodiments of the invention, it should be understood that numerous structural modifications and adaptations may be made without departing from the spirit of the invention.

What is claimed is:

1. A motor-driven fuel pump comprising:

a cylindrical housing;

a pump section fixedly mounted at one end portion of said housing so as to close the one end portion;

a motor section mounted in said housing for driving said pump section including a pair of magnets fixed to an inner circumferential surface of said housing, and each of said magnets having a wall thickness gradually decreasing from a circumferentially central portion to opposite ends thereof;

a cover member formed of a material capable of reducing sound conduction, said material having a specific gravity greater than 6.0 and is a vibration isolating alloy fixedly mounted at the other end portion of said housing so as to close the other end portion by caulking an end of said housing;

wherein an outer end surface of said cover member projects outwardly from the caulked end of said housing to increase a wall thickness of said cover member without increasing a total length of said housing, whereby a sound from said motor section is reduced.

2. The motor-driven fuel pump as defined in claim 1, wherein each of said opposite ends of said each magnet is chamfered at its inner edge to form a round surface.

3. The motor-driven fuel pump as defined in claim 1, wherein said motor section includes a brush holder for accommodating a brush, and an inner surface of said brush holder is coated with fluororesin.

4. The motor-driven fuel pump as defined in claim 3, wherein an outer surface of said brush is in substantially entire contact with the inner surface of said brush holder.

5. The motor-driven fuel pump as defined in claim 3, wherein an outer surface of said brush is formed with a plurality of guide projections contacting the inner surface of said brush holder.

* * * * *